US007731248B2

(12) United States Patent
Balbo Di Vinadio

(10) Patent No.: US 7,731,248 B2
(45) Date of Patent: Jun. 8, 2010

(54) ANTI-PANIC CONTROL DEVICE FOR DOORS

(75) Inventor: Aimone Balbo Di Vinadio, Turin (IT)

(73) Assignee: Savio SpA, Chiusa San Michele (Torino) (IT)

( * ) Notice: Subject to any disclaimer, the term of this patent is extended or adjusted under 35 U.S.C. 154(b) by 727 days.

(21) Appl. No.: 11/537,354

(22) Filed: Sep. 29, 2006

(65) Prior Publication Data

US 2007/0075551 A1 Apr. 5, 2007

(30) Foreign Application Priority Data

Sep. 30, 2005 (EP) ..... 05425680

(51) Int. Cl.
*E05B 65/10* (2006.01)
*E05B 65/00* (2006.01)

(52) U.S. Cl. ..... 292/92; 292/150; 292/279; 70/92

(58) Field of Classification Search ..... 292/92–94, 292/137, 146, 150, 279, 280; 70/91, 92
See application file for complete search history.

(56) References Cited

U.S. PATENT DOCUMENTS

| | | | | |
|---|---|---|---|---|
| 1,677,271 | A * | 7/1928 | Carroll | 292/92 |
| 2,765,648 | A * | 10/1956 | Hatcher | 70/264 |
| 2,991,107 | A * | 7/1961 | Eichacker et al. | 292/92 |
| 4,969,343 | A * | 11/1990 | Luker | 70/92 |
| 5,322,332 | A * | 6/1994 | Toledo et al. | 292/92 |
| 6,953,211 | B2 * | 10/2005 | Di Vinadio | 292/296 |

FOREIGN PATENT DOCUMENTS

| | | | |
|---|---|---|---|
| DE | 3244647 | A1 * | 6/1984 |
| EP | 0 481 931 | | 4/1992 |
| EP | 1 050 642 | | 11/2000 |
| FR | 2 814 190 | | 6/2003 |
| FR | 2 861 789 | | 5/2005 |
| FR | 2 863 000 | | 6/2005 |

OTHER PUBLICATIONS

EP Search Report, Application No. 05425680.5-2311, dated Aug. 21, 2006.

* cited by examiner

*Primary Examiner*—Carlos Lugo
(74) *Attorney, Agent, or Firm*—Patterson & Sheridan, L.L.P.

(57) ABSTRACT

Anti-panic control device for doors, comprising, a base structure, a spring latch mounted rotatable relative to the base structure around a main axis, the spring latch being able to rotate between a closed position and an open position and being associated to an elastic element which tends to maintain the spring latch in the open position, the spring latch having a slit able to receive a retaining element. a first locking element movable between an arresting position and a disengaged position, an actuating device able to move the first locking element in the disengaged position, and a second locking element movable relative to the spring latch between an arresting position and a disengaged position, the second locking element being thrust by elastic member towards the disengaged position and being thrust towards the locking position by the retaining element, the second locking element co-operating with the first locking element in such a way as to lock the spring latch in closed position when the first and the second locking elements are both in arresting position.

4 Claims, 9 Drawing Sheets

ANTI-PANIC CONTROL DEVICE FOR DOORS

CROSS-REFERENCE TO RELATED APPLICATIONS

This application claims benefit of European patent application number 05425680.5, filed Sep. 30, 2005, which is herein incorporated by reference.

BACKGROUND OF THE INVENTION

1. Field of the Invention

The present invention relates to an anti-panic control device for doors.

2. Description of the Related Art

A control device is disclosed in FR-A-2814190.

More specifically. FR-A-2814190 discloses an anti-panic control device comprising an oscillating spring latch provided with a slit able to receive a retaining element. The spring latch is provided with an arresting tooth that co-operates with a locking element borne by an oscillating cam. The oscillating cam prevents the rotation of the spring latch towards an open position. The control lever of the device controls the motion of the oscillating cam away from the spring latch, in such a way as to leave the spring latch free to rotate towards the open position.

In this known solution, the spring latch can be locked in closed position even when the door is open. If this occurs, when the door is closed the spring latch impacts against the fixed part of the door frame and prevents the door from closing. If an attempt is made to close the door when the spring latch is locked in closed position, the spring latch or the door frame can be damaged.

SUMMARY OF THE INVENTION

The object of the present invention is to provide an improved control device that allows to overcome the aforesaid drawbacks.

BRIEF DESCRIPTION OF THE DRAWINGS

The present invention shall now be described in detail with reference to the accompanying drawings, provided purely by way of non limiting example, in which.

DETAILED DESCRIPTION

Figure 1:
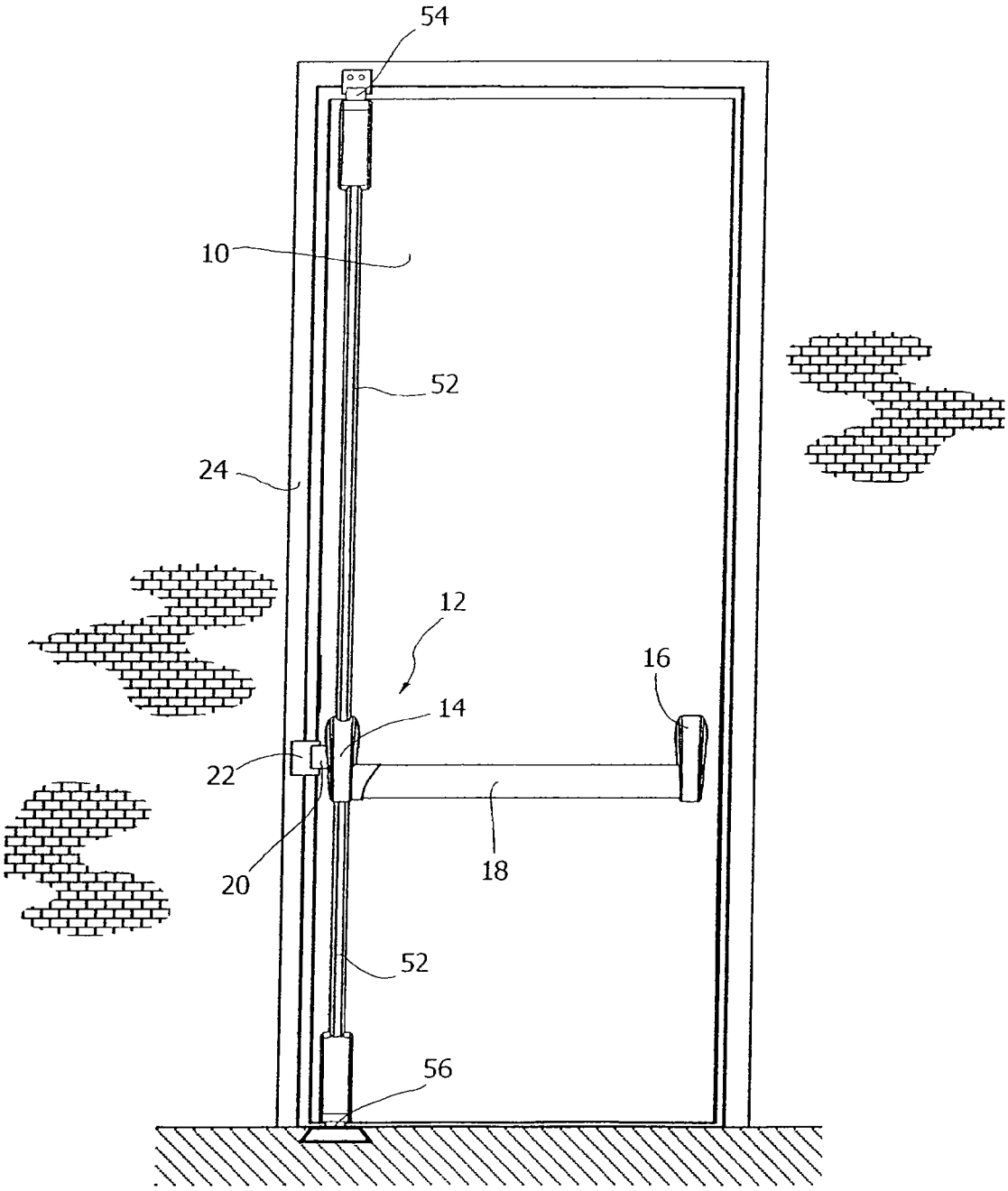
FIG. 1 is a front view of a door provided with an anti-panic control device.
Figure 2:
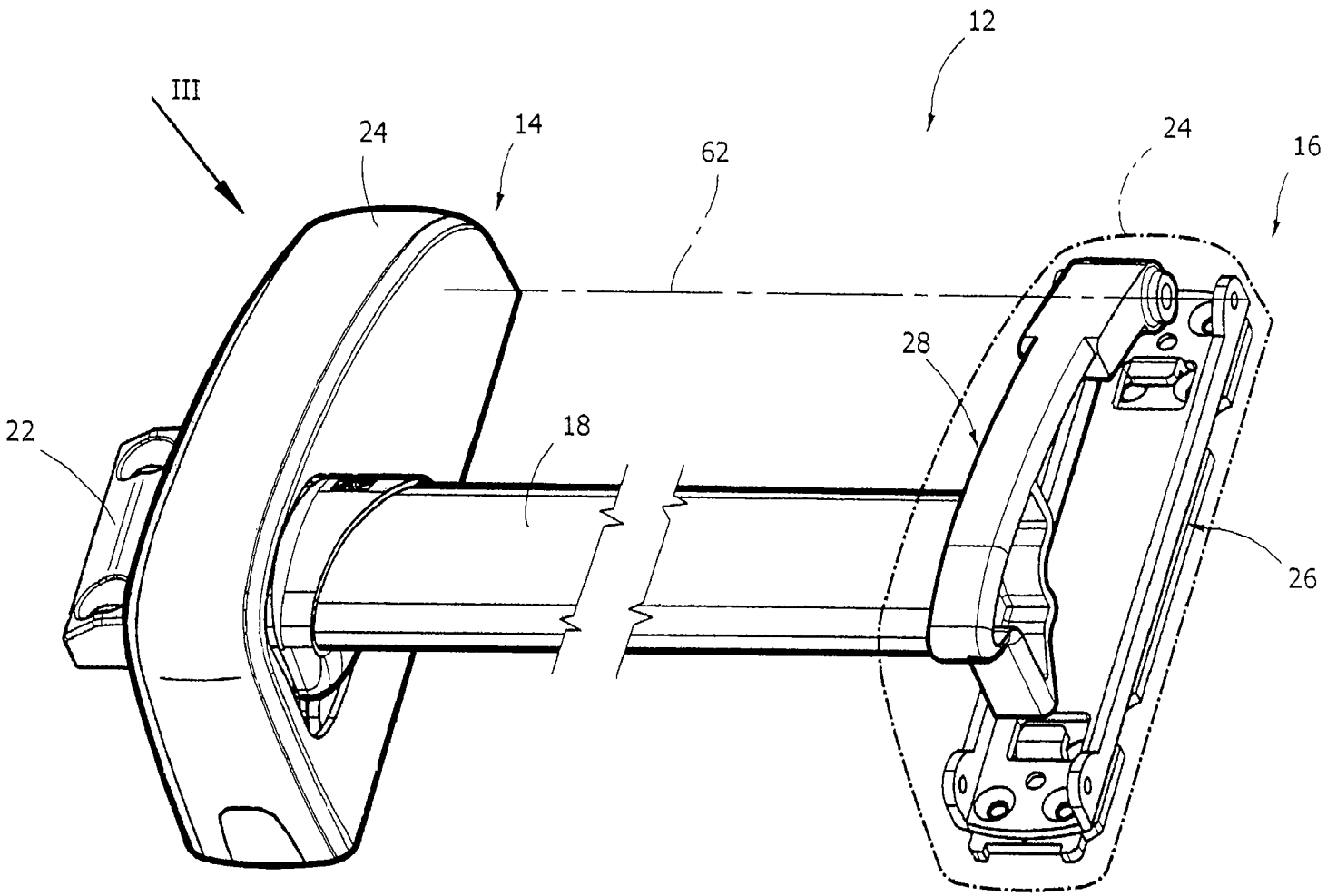
FIG. 2 is a perspective view of a control device according to the present invention.
Figure 3:
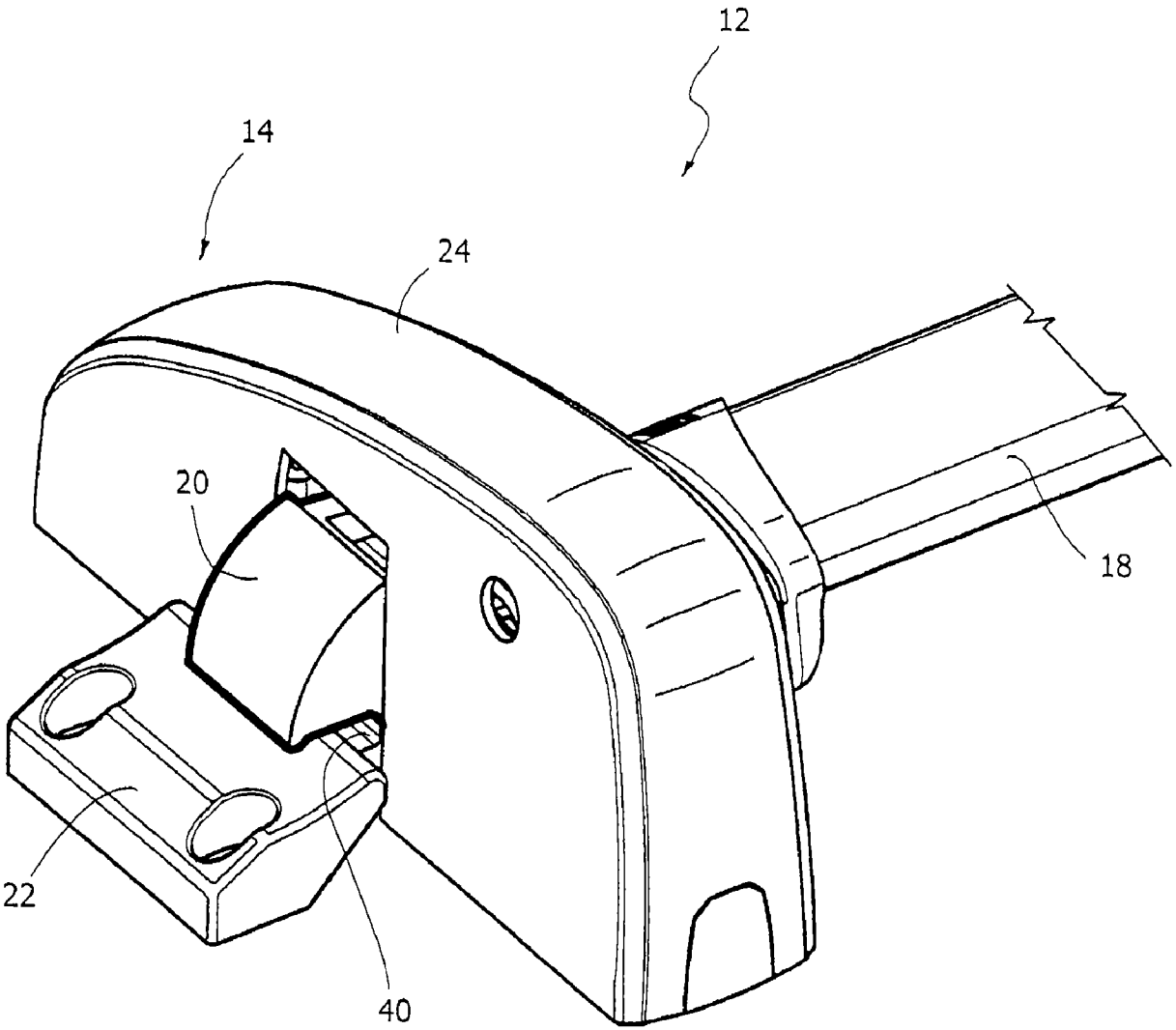
FIG. 3 is a perspective view of the part indicated by the arrow III in FIG. 2.
Figure 4:
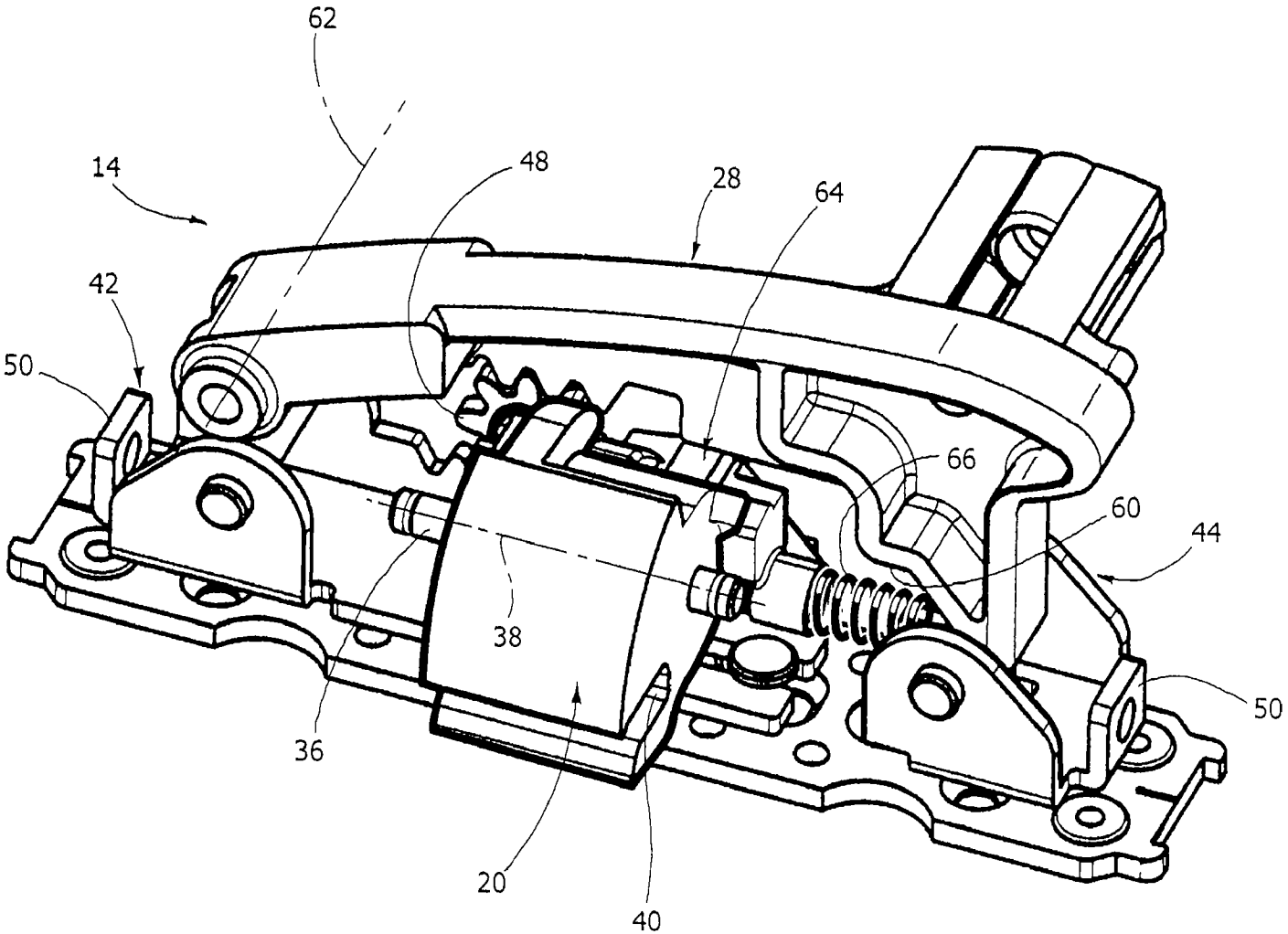
FIG. 4 is a perspective view of the control device of FIG. 3 without the covering element and in which some parts of the base structure have been removed to simplify comprehension of the figure.

With reference to FIG. 1, the number 10 designates a door provided with an anti-panic control device 12. The control device 12 comprises two lateral supports 14, 16 bearing an actuation bar 18. The support 14 comprises a spring latch 20 which co-operates with a retaining element 22 fastened to the fixed frame 24 of the door 10.

With reference to FIGS. 2 through 5, each support element 14, 16 of the control device 12 comprises a respective covering element 24 fastened to a base structure 26, preferably made of sheared and bent metal plate. The base structures 26 of the two support elements 14, 16 are provided with holes so they can be fastened by means of screws. Each support element 14, 16 comprises an actuating lever 28 articulated around a horizontal axis 62 to the upper part of the respective base structure 26. Each end of the bar 18 is fastened to a respective actuating lever 28. In the remainder of the description, the terms "upper" and "lower" refer to the position of the device 12 mounted on a door.

Figure 5:
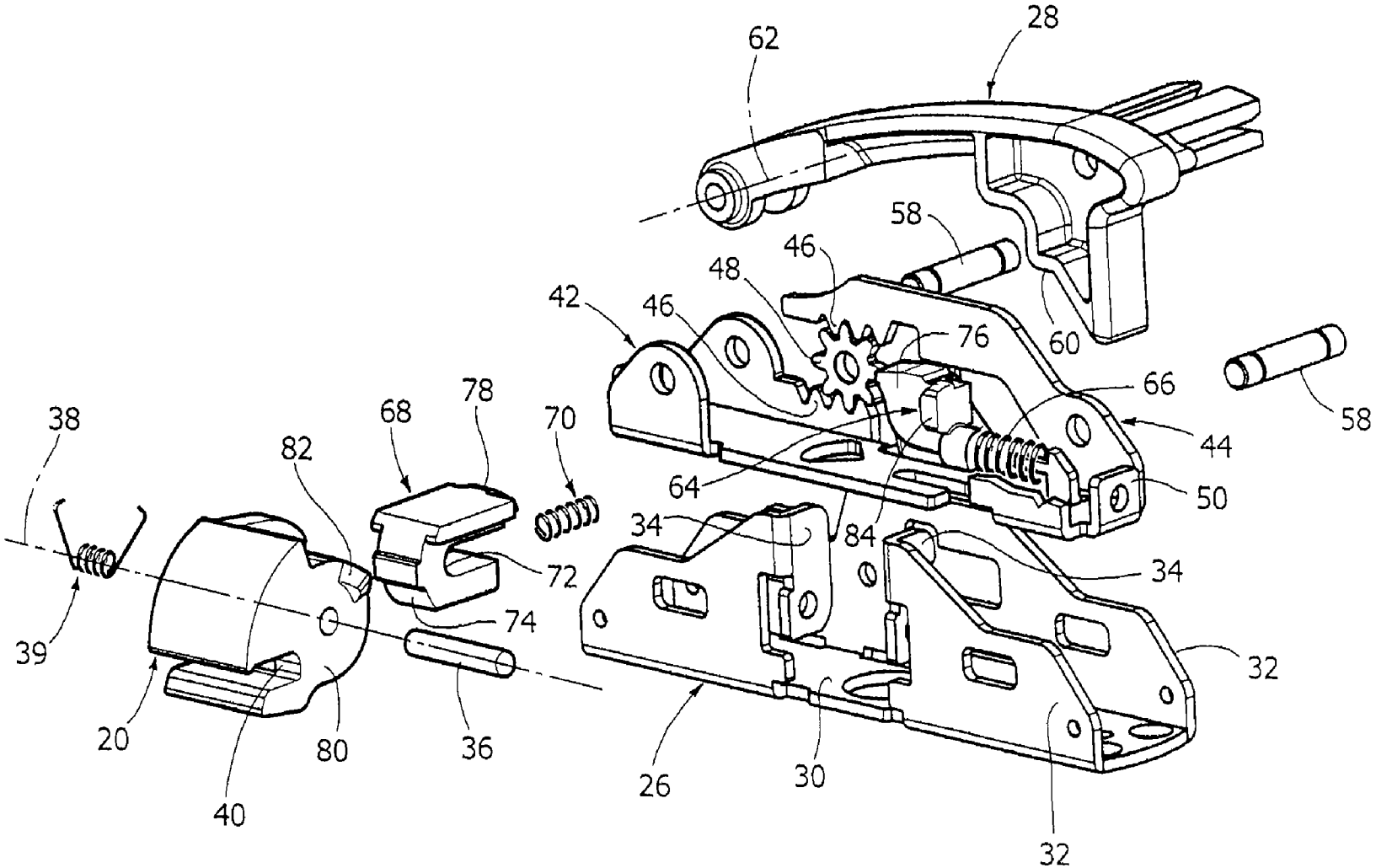
FIG. 5 is an exploded perspective view of the control device according to the invention.

With reference to FIG. 5, the base structure 26 comprises a bottom wall 30 and two lateral walls 32. One of the lateral walls 32 has, centrally positioned, an opening whereat the spring latch 20 is mounted. The spring latch 20 is articulated by means of a pivot pin 36 between two wings 34 of the lateral wall 32. The spring latch 20 is free to rotate relative to the base structure 26 around a main axis 38 between an open position and a closed position. A pin spring 39, coaxial relative to the axis 38, elastically returns the spring latch 20 to its open position. The spring latch 20 has a slit 40 that is able to receive a part of the retaining element 22 (see, for example, FIG. 3).

With reference again to FIG. 5, the base structure 26 bears two cursors 42, 44 mounted between the lateral walls 32 of the base structure 26 and free to slide relative to the base structure 26 in parallel direction to the axis of articulation of the spring latch 20. The two cursors 42, 44 have respective rack teeth 46 which enmesh from opposite sides with an idle gearwheel 48 mounted in freely rotatable fashion on one of the lateral walls 32 of the base structure 26. The mutual coupling between the cursors 42, 44 by means of the rack teeth 46 and of the gearwheel 48 causes the two cursors 42, 44 are constrained to move in mutually opposite directions. Each of the two cursors 42, 44 has at one of its end a bent flange 50 provided with a hole, preferably threaded, which enables to fasten the cursor to a respective transmission rod 52 (FIG. 1) for the disengagement of an upper or lower locking element 54, 56.

The two cursors 42, 44 are provided with respective transverse idle pivot pins 58. The pivot pin 58 of the lower cursor 44 co-operates with a cam surface 60 of the actuating lever 28. When the actuating bar 18 is pressed towards the door 10, the two levers 28 of the control device 12 oscillate around a common horizontal axis 62. The lever 28 co-operates with the lower cursor 44 by means of the cam surface 60 and the transverse pivot pin 58 and actuates an upwards sliding of the lower cursor 44. Consequently, the upper cursor 42 moves downwards being connected to the lower cursor 44 by means of the transmission with gearwheel 48 and racks 46. This movement of the cursors 42, 44 towards each other controls the unlocking of the upper and lower locking elements 54, 56 through the transmission rods 52. This solution enables to use the aforesaid mechanism both for doors with right-side opening, and for doors with left-side opening simply by reversing the supports 14, 16 and rotating the rotating the support 14 by 180°.

With reference to FIG. 5, the control device comprises a first locking element 64 which is movable relative to the base structure 26 along a rectilinear direction that is parallel to the main axis 38. The first locking element 64 is movable between an arresting position and a disengagement position.

The first locking element 64 engages a guide of the base structure 26 and it is constrained to move in rectilinear position relative to the base structure 26 between two end stop position.

A helical compression spring 66 is interposed between the first locking element 64 and the cursor 44. The spring 66 tends to thrust the cursor 44 downwards and, simultaneously, it tends to thrust the first locking element 64 upwards towards its arresting position.

The spring latch 20 has an opening in which is slidably mounted a second locking element 68. The second locking element 68 is slidable relative to the spring latch 20 between an arresting position and a disengaged position. The second locking element 68 is slidable orthogonally relative to the main axis 38 and it is thrust by a helical compression spring 70 towards the disengaged position. The spring 70 is preferably positioned between the pivot pin 36 and a surface 72 of the second locking element 68. In the disengaged position, the second locking element 68 projects partially within the slit 40. When the retaining element 22 is engaged in the slit 40, the second locking element 68 is thrust by the retaining element 22 towards its locking position, against the action of the helical spring 70. When instead the retaining element 22 is not engaged within the slit 40 of the spring latch 20, the second arresting organ 68 moves to the disengaged position under the action of the elastic force of the spring 70.

The first locking element 64 is thrust by the spring 66 into its arresting position and moves towards its disengagement position when the lever 28 is pressed. The first locking element 64 has an appendage (not shown in the drawings) which co-operates with the upper cursor 42. When the lever 28 is operated by pushing the actuating bar 18 towards the door, the lower cursor 44 moves upwards and the upper cursor 42 moves downwards, as described previously. The downwards movement of the upper cursor 42 thrusts the first locking element 64 towards its disengagement position.

The first and the second locking element 64, 68 are positioned in such a way as to co-operate with each other in abutment relationship when they are both in the respective arresting positions. In practice, the first locking element 64 constitutes an abutment against which acts the second locking element 68. The mutual abutment between the first and the second locking element 64, 68 prevents the rotation of the spring latch 20 around the axis 38 from the closed position towards the open position. Therefore, when both locking elements 64, 68 are in their arresting position, the spring latch 20 is maintained in its closed position against the action of the spring 39 which tends to thrust it towards its open position. When either of the two locking elements 64, 68 is in its disengaged position, the spring latch 20 is no longer maintained in its closed position and it is free to rotate towards the open position under the return action of the spring 39.

Figure 6:
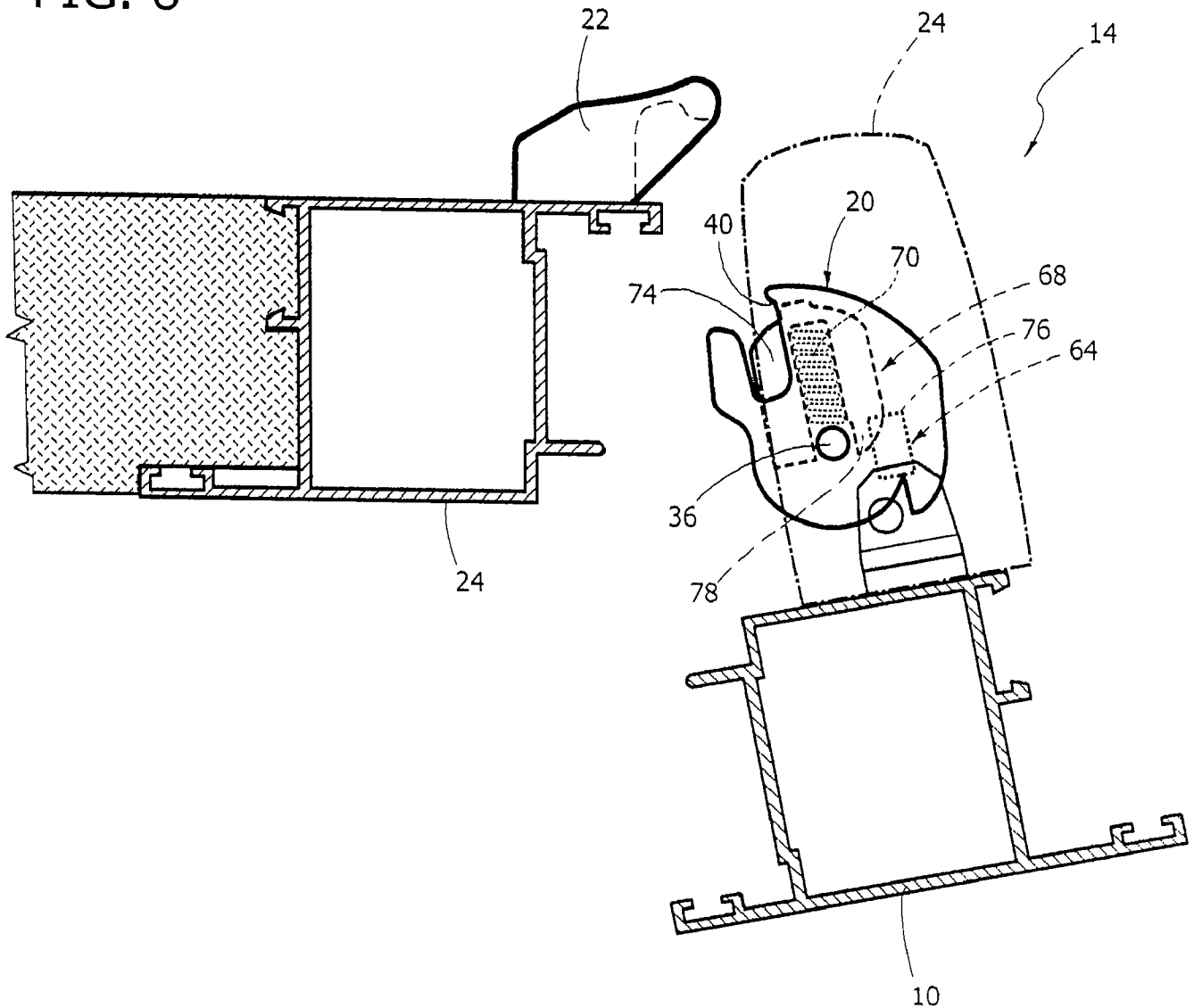
FIGS. 6, 7 and 8 are plan views showing the closing of a door provided with a control device according to the present invention.
Figure 7:
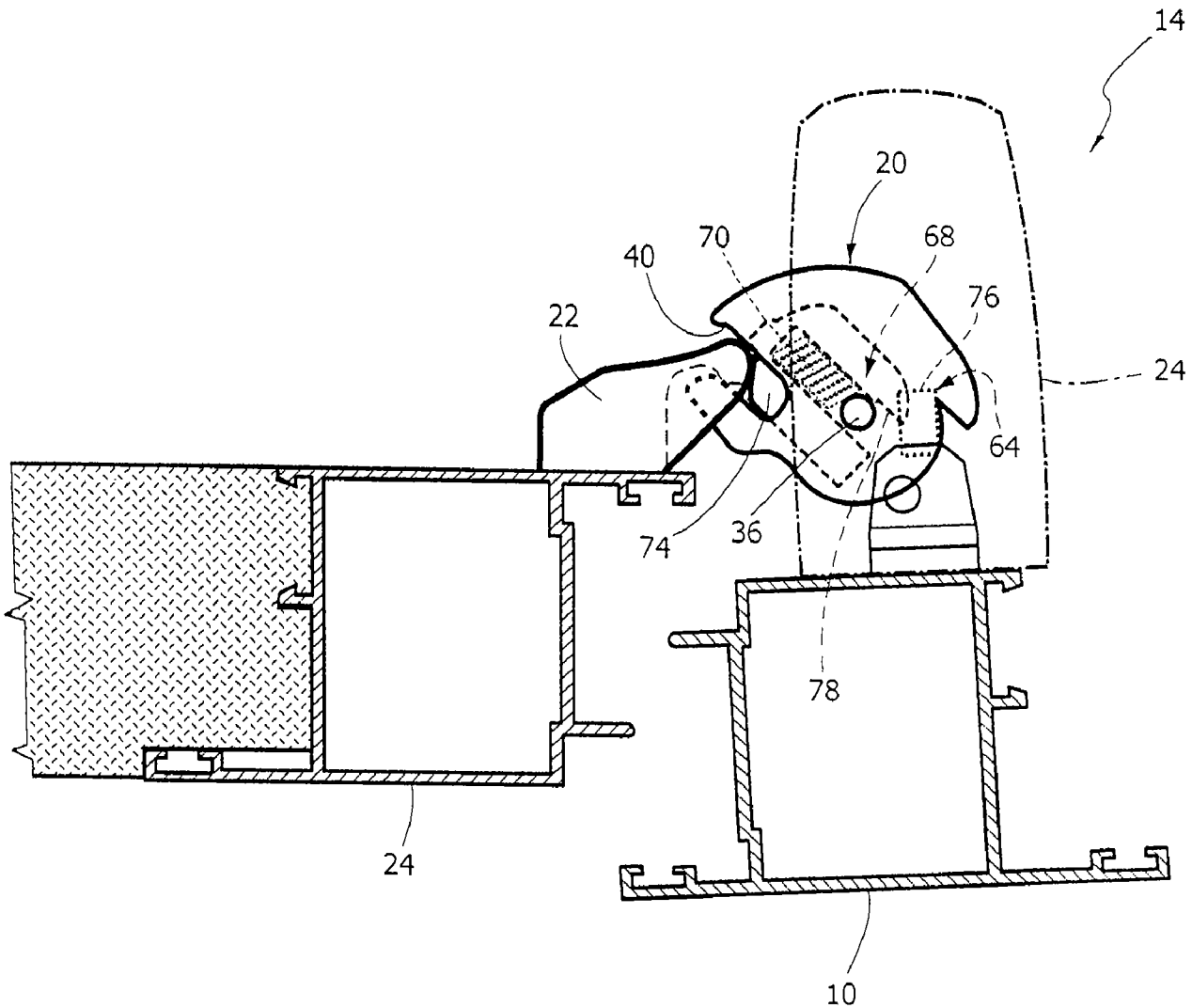
Figure 8:
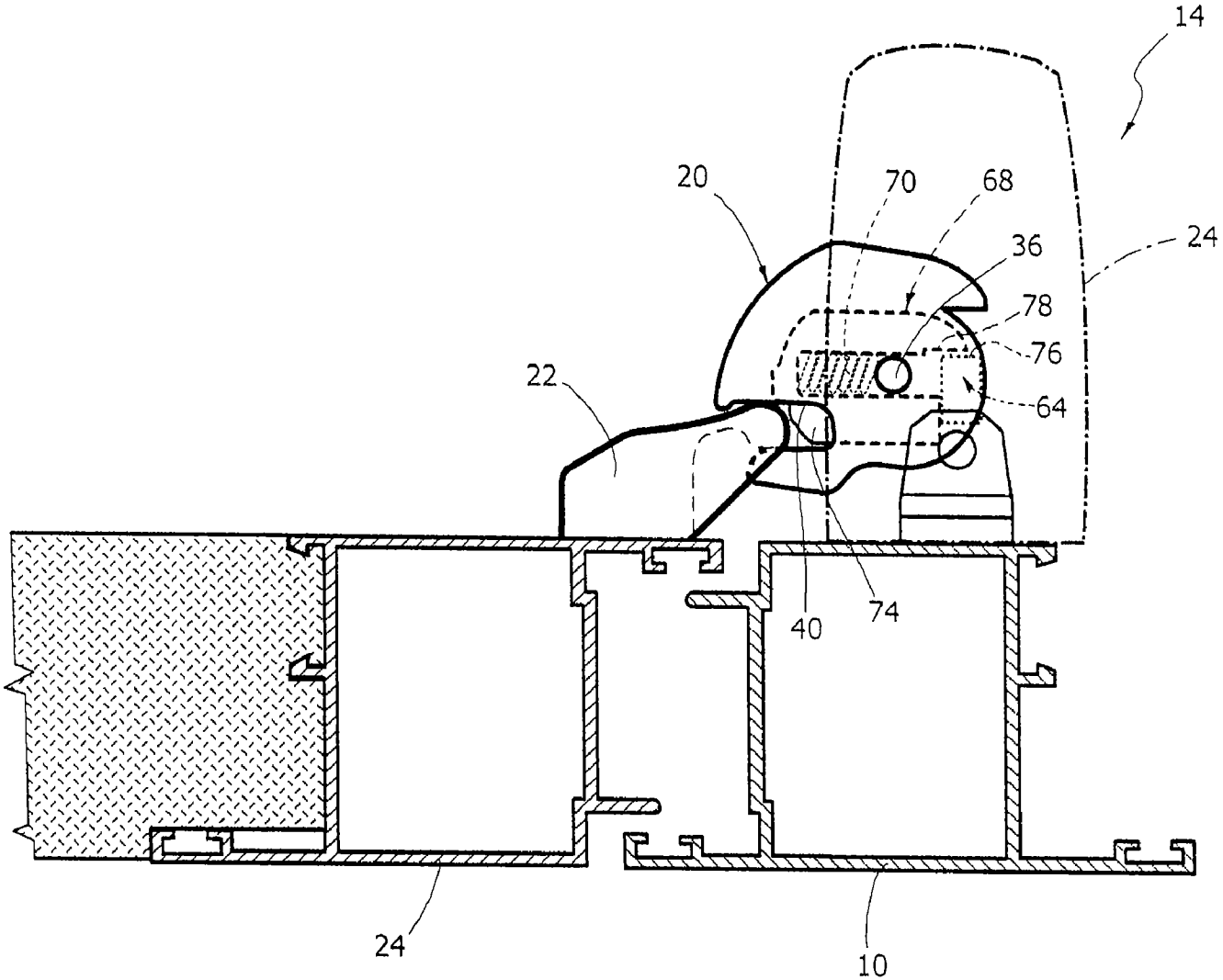

FIGS. 6, 7 and 8 schematically show the operation of the device according to the present invention during the closure of the door 10. FIG. 6 shows the device in open door position, FIG. 7 shows the device in conditions of partially closed door and FIG. 8 shows the device in completely closed door conditions.

In the configuration of FIG. 6, the spring latch 20 is in open position. The spring latch 20 is thrust by the force of the spring 39 towards the position shown in FIG. 6 and it abuts against a fixed surface. The second locking element 68 is in the disengaged position and its portion 74 extends in the slit 40. The first locking element 64 and the second locking element 68 have respective arresting teeth designated with the references 76, 78. The first locking element 64 is in the arresting position whilst the second locking element is in the disengaged position. In this condition, the two arresting teeth 76, 78 are not mutually engaged.

As shown in FIG. 7, during the closure of the door the retaining element 22 is inserted into the slit 40 of the spring latch 20 and makes the spring latch 20 rotate counter-clockwise towards its closed position. During this movement, the portion 74 of the second locking element 68 is thrust towards the interior of the slit 40 by the retaining element 22. The second locking element 68 is then progressively translated towards its arresting position to the extent to which it is thrust by the retaining element 22.

In the fully closed position shown in FIG. 8, the spring latch 20 is rotated in its closed position. The retaining element 22 thrusts the second locking element 68 towards its arresting position. The two arresting teeth 76, 78 mutually co-operate in abutment relationship and prevent a clockwise rotation of the spring latch 20. In the position of FIG. 8, the spring latch 20 is locked in closed position and it prevents the opening of the door.

Starting from the configuration of FIG. 8, pressing the actuating bar, the first locking element 64 moves towards its disengagement position, freeing the two arresting teeth 76, 78 from the mutual abutment engagement. In this condition, the spring latch 20 is free to rotate towards its open position and the door 10 can be opened.

With reference to FIG. 5, the spring latch 20 has a planar lower front surface 80 whereon is formed a tooth shaped projecting cam 82. The cam 82 co-operates with a lateral projection 84 of the first locking element 64.

Figure 11:
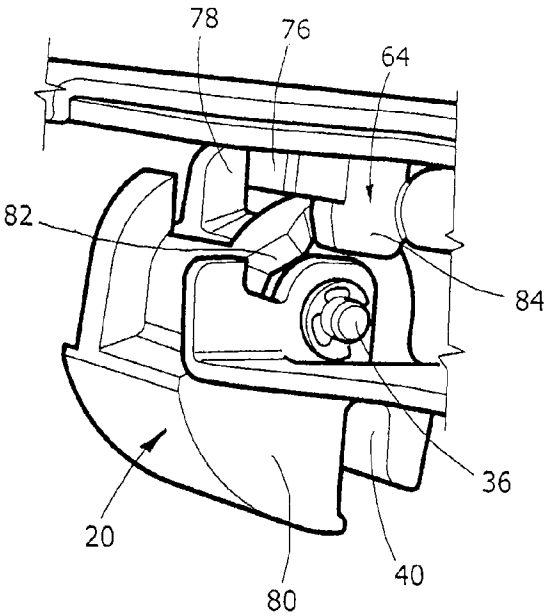
FIGS. 9, 10 and 11 are perspective views showing the spring latch of the control device according to the invention in positions corresponding to the positions of FIGS. 6, 7 and 8.
Figure 10:
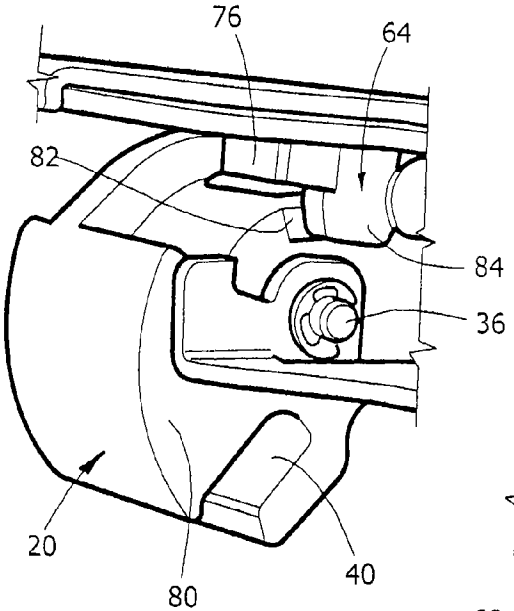
Figure 9:
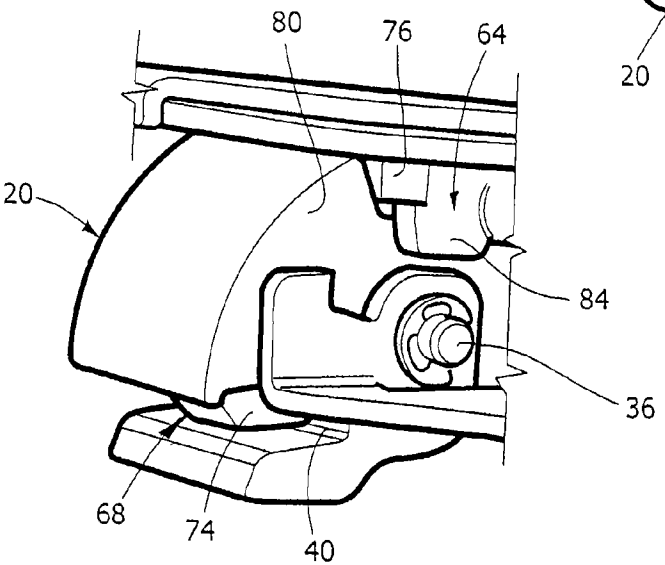

With reference to FIGS. 9, 10 and 11, during the rotation from the open position (FIG. 9) towards the closed position (FIG. 11) the cam 82 thrusts the first locking element 64 downwards (FIG. 10) before the two arresting teeth 76, 78 become mutually engaged. In the position with the spring latch closed, shown in FIG. 11, the cam 82 has overtaken the lateral projection 84 and the first locking element assumes its arresting position in which the two arresting teeth 76, 78 abut against each other. The downwards thrust of the first locking element 64 through the cam 82 facilitates the engagement between the arresting teeth 76, 78 and reduces the force necessary for the mutual engagement between these teeth.

While the foregoing is directed to embodiments of the present invention, other and further embodiments of the invention may be devised without departing from the basic scope thereof, and the scope thereof is determined by the claims that follow.

The invention claimed is:

1. An anti-panic control device for doors, comprising:

a base structure;

a spring latch mounted rotatable relative to the base structure around a main axis, the spring latch being able to rotate between a closed position and an open position and being associated to an elastic element which tends to maintain the spring latch in the open position, the spring latch having a slit able to receive a retaining element;

a first locking element movable relative to the base structure between an arresting position and a disengaged position, a second locking element movable relative to the spring latch between an arresting position and a disengaged position, the second locking element being thrust by elastic means towards the disengaged position and being thrust towards the arresting position by said retaining element, the second locking element co-operating with the first locking element in such a way as to lock the spring latch in closed position when the first and the second locking elements are both in arresting position, the spring latch being free to rotate towards the open position when the first or the second locking element are in disengaged position; and an actuating device configured to move the first locking element in the disengaged position, wherein said actuating device comprises a lever articulated to the base structure around an axis that extends transversely to said main axis and wherein said actuating device comprises first and second cursors movable relative to the base structure along a rectilinear direction, parallel to said main axis, said first cursor co-operating with a cam surface of said lever;

wherein operation of the lever causes the cam surface to interact and move said first cursor, the movement of said first cursor causes movement of the second cursor relative to the first cursor, the movement of said second cursor thrusts the first locking element towards the disengaged position thereby allowing the spring latch to rotate toward the open position.

2. The device as claimed in claim 1, wherein said cursors co-operate with each other by means of a mechanism with gearwheel and racks.

3. The device as claimed in claim 1, further comprising an elastic element in compression positioned between the first locking element and one of said cursors.

4. An anti-panic control device for doors, comprising:

a base structure;

a spring latch mounted rotatable relative to the base structure around a main axis, the spring latch being able to rotate between a closed position and an open position and being associated to an elastic element which tends to maintain the spring latch in the open position, the spring latch having a slit able to receive a retaining element;

a first locking element movable relative to the base structure between an arresting position and a disengaged position, wherein the spring latch includes a projecting cam co-operating with the first locking element and arranged in such a way as to temporarily move the first locking element away from its arresting position before the spring latch reaches its closed position;

a second locking element movable relative to the spring latch between an arresting position and a disengaged position, the second locking element being thrust by elastic means towards the disengaged position and being thrust towards the arresting position by said retaining element, the second locking element co-operating with the first locking element in such a way as to lock the spring latch in closed position when the first and the second locking elements are both in arresting position, the spring latch being free to rotate towards the open position when the first or the second locking element are in disengaged position; and an actuating device configured to move the first locking element in the disengaged position, the actuating device comprising a lever and first and second cursors, wherein the operation of the lever causes the first cursor to move, movement of said first cursor will move the second cursor relative to the first cursor, the movement of said second cursor thrusts the first locking element towards the disengaged position thereby allowing the spring latch to rotate toward the open position.

* * * * *